United States Patent [19]

Wennström

[11] Patent Number: 4,753,025

[45] Date of Patent: Jun. 28, 1988

[54] SIGN ARRANGEMENT

[75] Inventor: Ari Wennström, Knutby, Sweden

[73] Assignee: AB Ariab, Upplands Vasby, Sweden

[21] Appl. No.: 13,872

[22] Filed: Feb. 12, 1987

[30] Foreign Application Priority Data

Sep. 16, 1986 [SE] Sweden ..... 8603901

[51] Int. Cl.[4] ..... G09F 11/02

[52] U.S. Cl. ..... 40/505; 40/470; 40/503

[58] Field of Search ..... 40/503, 504, 505, 506, 40/493, 584, 470, 473, 482, 484

[56] References Cited

U.S. PATENT DOCUMENTS

| | | | |
|---|---|---|---|
| 2,680,316 | 6/1954 | Webster et al. | 40/505 |
| 3,304,638 | 2/1967 | Grandell et al. | 40/505 |
| 3,335,513 | 8/1967 | Mann | 40/505 |
| 3,383,785 | 5/1968 | Werner | 40/505 |
| 3,643,359 | 2/1972 | Nowicki | 40/505 |
| 3,696,536 | 10/1972 | Reese et al. | 40/505 |
| 4,021,946 | 5/1977 | Bradshaw | 40/504 |
| 4,274,218 | 6/1981 | Harvey | 40/505 |
| 4,638,580 | 1/1987 | Giannetti et al. | 40/503 |

*Primary Examiner*—Gene Mancene
*Assistant Examiner*—Michael Lynch
*Attorney, Agent, or Firm*—Young & Thompson

[57] ABSTRACT

The invention relates to an arrangement in signs of the kind which comprise a plurality of narrow, elongated prisms arranged in side-by-side relationship and the side faces of which together form a plurality of sign surfaces in different rotational positions of the prisms. The prisms are rotated by a drive shaft, common to all prisms, via a respective bevel gear drive. In accordance with the invention, each driving gear wheel of the bevel gear drive is journalled for rotation in a bearing which is carried by an individual bearing support, which is guided for individual movement axially along tracks which extend longitudinally along the one frame side-member of the sign, and which bearing supports can be locked in selected positions along the tracks.

7 Claims, 1 Drawing Sheet

SIGN ARRANGEMENT

The present invention relates to an arrangement in signs of the kind which comprise a plurality of rotatable narrow, elongated prisms which are arranged in side-by-side relationship and the side faces of which together form a plurality of sign surfaces in the various positions of rotation of the prisms, the prisms being supported for rotation at each end thereof in respective frame side-members and being rotatably driven in one frame side-member via a respective bevel gear drive, each of which bevel gear drives includes a driving gear which is driven by a drive shaft that extends in said frame side-member, longitudinally therealong and is common to all said drives, and further includes a driven gear which is carried on the end of a respective prism and engages an associated driving gear.

In earlier known sign arrangements of this kind the elements which carry the drive shaft and bevel gear drives comprise elongated, sheet-metal angle bars which extend along the length of the aforesaid frame side-member and which are connected thereto in a manner to support, in common, the drive shaft and bevel gear drives. To this end the metal angle bars are provided with a plurality of holes for receiving the drive shaft bearing, the gear wheel bearings, and also the dogging devices used to rotate the prisms, each of which prisms forms a minor or part section of the overall sign surface. Because of the large number of holes required in the angle bars, the distances between the holes must be measured with extreme accuracy, which renders fitting of the various sign components difficult. Furthermore, a bearing or journalling system such as this is burdensome with regard to a sign frame in which there is only one specific centre distance between the various prisms, which means that separate bearing supporting elements must be formed, or constructed, for signs of mutually different sizes where the distance between the adjacent prisms varies.

An object of the present invention is to overcome the drawbacks associated with these known sign arrangements. This object is achieved with an arrangement of the kind described in the introduction, by arranging for each driving gear wheel to be rotatably journalled in a bearing carried by a separate bearing support which is guided for movement along tracks extending longitudinally along said one frame side-member, and which can be locked in position in said tracks.

Figure 1:
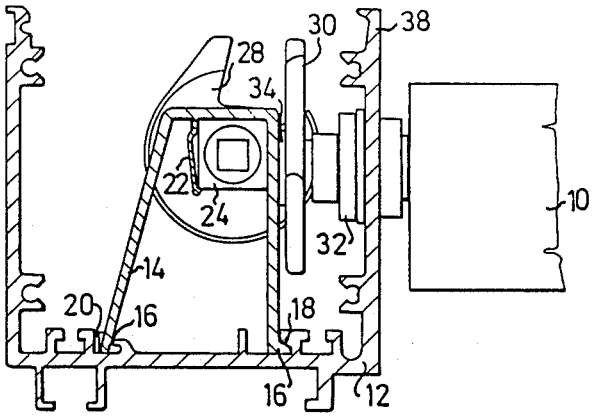
Figure 2:
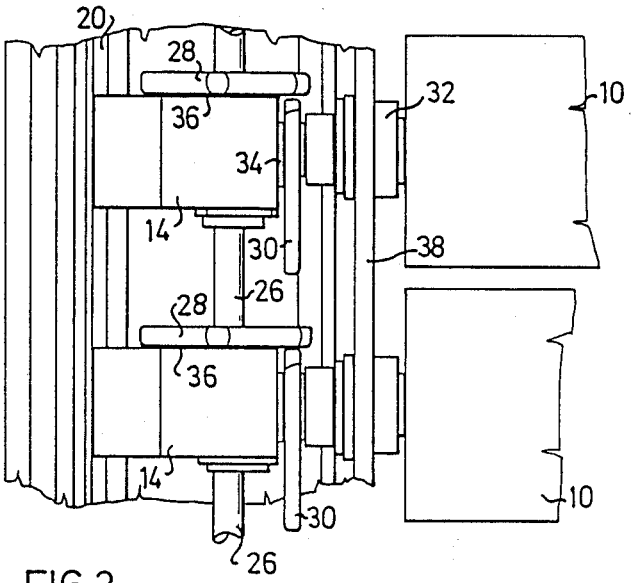

Other features of the invention and advantages afforded thereby will be made apparent in the following description, which is made with reference to the accompanying drawings, in which FIG. 1 is a cross-sectional view of a frame side-member having mounted thereon a bearing support assembly for a drive shaft and a bevel gear drive; and FIG. 2 is a plan view of the frame side-member illustrated in FIG. 1, where two bearing support assemblies according to the invention are illustrated.

A sign of the kind to which the invention relates comprises two mutually parallel frame side-members, and a plurality of mutually parallel stave-like prisms 10, preferably three-sided prisms, which extend between the frame side-members and which are rotatably journalled on said side-members for intermittent rotation in a manner known per se, such that the side surfaces of the prisms together form different sign surfaces in different positions of rotation.

The drive mechanism for rotation of the prisms 10 is mounted on one frame side-member 12, which has the form of a U-shaped profile section and which may be closed-off with the aid of a cover (not shown in FIG. 1) so as to protect, or to enclose, the drive mechanism in the frame. The U-shaped frame side-member 12 has mounted thereon a number of bearing supports 14 which, in this instance, have the form of U-shaped bracket structures. The base parts, or feet, 16 of the bracket structures are guided for movement axially along tracks 18 and 20, which extend longitudinally along the bottom of the frame side-member 12, and can be locked in selected positions therealong, e.g. with the aid of suitable locking means not shown.

The U-shaped bracket structures 14 have mounted thereon an internal, sprung flange 22 which carries a bearing or journal 24 for a longitudinally extending, through-passing drive shaft 26, which is operative for driving a plurality of, or all of, the sign prisms 10. The bearing 24, which is held in the bracket structure 14, by means of the sprung flange 22, which functions in the manner of a snap-in coupling, carries a driving gear wheel 28, which in this case has the form of a clawed disc. The driving wheel 28 is arranged to engage a driven gear wheel, which, in this instance, has the form of a triangular plate 30 and is positioned opposite the driving wheel 28 at an angle of 90° thereto, and to rotate the triangular plate intermittently, in a known manner, and therewith also to rotate the prisms 10 through the intermediary of dogging devices 32, with the driving gear wheel 28 in continuous rotation. The drive shaft 26 is driven by an electric motor via a gear box, or some other speed control device, and a slipping clutch mechanism, therewith to prevent damage from occurring in the event of a foreign object becoming lodged between the prisms.

The driven wheel, or triangular plate, 30 is journalled, via a protruding hub part 34, in a hole (not shown) located in one side wall of the bracket structure 14, and abuts the driving wheel 28 via an intermediate spring plate or washer 36, which takes up any clearance between the gear wheels.

Each dogging device 32 is journalled in a through-bore located in the side-wall of the frame member 12. The axis of this through-bore is slightly offset beneath the centre axis of the drive shaft 26, so as to facilitate thereby the transmission of driving forces between the gear wheels 28 and 30.

Each bearing bracket 14 on the frame side-member 12 can be adjusted to a position centrally opposite a respective prism 10 and locked in this position, so as to be able to receive the through-passing drive shaft without creating any problems relating to tolerances during a fitting operation. Because the vertical and lateral positions (as seen in FIG. 1) of the drive shaft bearing 24 are fixed in the bearing bracket 14, and because the position of the bearing bore that receives the hub part of the triangular driven wheel 30 is fixed in the bracket 14, the drive shaft 26 and the bevel gear drives 28, 30 can be readily fitted in position in correspondence with the position of each respective prism 10, irrespective of the centre distances therebetween. This enables the bearing bracket 14 to be used in connection with sign frames in which mutually different centre distances are employed between the stave-like prisms. Considerable advantages from the aspect of assembly and manufacture are afforded hereby, in comparison with known sign constructions of a similar kind.

I claim:

1. In an arrangement in signs of the kind which include a plurality of rotatable, narrow, elongated prisms which are arranged in side-by-side relationship and the side faces of which together form a plurality of sign surfaces in different rotational positions of the prisms, and in which arrangement the prisms are carried for rotation at each end thereof in a respective frame side-member and rotatably driven via a respective bevel gear drive mounted on the one frame side-member, each of which bevel gear drives comprises a driving gear wheel which is driven by a common drive shaft extending in the longitudinal direction of the frame side-member and driven gear wheels which are connected to the ends of respective prisms and engage the respective driving gear wheels; the improvement in which each driving gear wheel is journalled for rotation in a bearing carried by an individual bearing support, means mounting said individual bearing supports for individual movement along tracks that extend longitudinally along the one frame side-member, and means for releasably locking each said individual bearing support in position in said tracks.

2. An arrangement according to claim 1, characterized in that the bearing supports have a substantially U-shaped cross-sectional profile.

3. An arrangement according to claim 1, characterized in that the bearing supports have provided in a side wall thereof that faces the prisms a respective bearing hole or aperture in which a hub part of an associated driven gear wheel is journalled.

4. An arrangement according to claim 3, characterized in that the geometric axis of the bearing aperture is offset slightly in relation to the centre axis of the drive shaft.

5. An arrangement according to claim 1, characterized in that the bearings of the driving gear wheel are fixed in the bearing supports by means of a snap-in coupling.

6. An arrangement according to claim 5, characterized in that the snap-in coupling comprises a sprung flange provided in respective bearing supports.

7. An arrangement according to claim 1, in wihch the driving gear wheel comprises a clawed disc and the driven gear wheel comprises a triangular plate, characterized in that a spring plate or washer is arranged between the clawed disc and the triangular plate for the purpose of taking up clearance therebetween.

* * * * *